United States Patent [19]

Willington

[11] 4,344,237

[45] Aug. 17, 1982

[54] WOOD DRYING KILN

[75] Inventor: John M. Willington, Mount Eliza, Australia

[73] Assignee: A.P.M. Wood Products Pty. Ltd., Tumut, Australia

[21] Appl. No.: 214,683

[22] Filed: Dec. 9, 1980

[30] Foreign Application Priority Data

Dec. 13, 1979 [AU] Australia ..... PE1707

[51] Int. Cl.[3] ..... F26B 9/06

[52] U.S. Cl. ..... 34/191; 34/225

[58] Field of Search ..... 34/191, 225, 233; 432/144, 145

[56] References Cited

U.S. PATENT DOCUMENTS

| | | | |
|---|---|---|---|
| 3,149,932 | 9/1964 | Bachrich | 34/191 |
| 3,659,352 | 5/1972 | Cook | 34/191 |
| 3,720,003 | 3/1973 | Huthmann | 34/225 |
| 4,039,278 | 8/1977 | Denholm | 34/225 |

*Primary Examiner*—Larry I. Schwartz

*Attorney, Agent, or Firm*—Mason, Fenwick & Lawrence

[57] ABSTRACT

This invention relates to a kiln for drying timber comprising:

an elongated housing having a base, two side walls and a top wall and two end walls defining a timber treatment zone;

a gas circulation passageway having a top passageway portion extending over said timber treatment zone, a side passageway portion extending down one side of said timber treatment zone, a treatment passageway portion extending through said timber treatment zone, and a side passageway portion extending up the other side of said timber treatment zone merging with said top passageway portion, each said side wall being sloped whereby each of said side passageway portions is broad at the top of the kiln and narrower at the bottom of the kiln thereby to provide a substantially even rate of flow of gases at various levels within said treatment zone; and, reversible gas circulation means within said top passageway for maintaining the circulation of treatment gas in said other direction through said gas passageway thereby the direction of gas flowing through said treatment zone may be reversed.

6 Claims, 6 Drawing Figures

WOOD DRYING KILN

BACKGROUND OF THE INVENTION

This invention relates to a kiln for drying timber and in particular Pinus radiata and to a method of operating a kiln. In the preparation of timber it is usual for green sawn timber to be placed into a kiln and heated. The objective is to remove moisture from the timber. If the temperature is low, the time taken to dry the timber sufficiently for commercial purposes is very high, correspondingly reducing the output of the kiln. If the dry bulk temperature is raised, say to 120° C., drying is more rapid and the output increases but problems arise in the timber. For example, there may be distortion of the timber possibly resulting from uneven drying. Cracks may appear at knots. Surface checking may occur and there may be an undesirable change in the colour of the timber.

The objective of the present invention is to provide a kiln and a method of drying timber where the kiln output is high and the known disadvantages of accelerated drying avoided at least to an acceptable level.

SUMMARY OF THE INVENTION

According to one aspect the invention provides a kiln for drying timber comprising:

an elongated housing having a base, two side walls and a top wall and two end walls defining a timber treatment zone;

a gas circulation passageway having a top passageway portion extending over said timber treatment zone, a side passageway portion extending down one side of said timber treatment zone, a treatment passageway portion extending through said timber treatment zone, and a side passageway portion extending up the other side of said timber treatment zone merging with said top passageway portion, each said side wall being sloped whereby each of said side passageway portions is broad at the top of the kiln and narrower at the bottom of the kiln thereby to provide a substantially even rate of flow of gases at various levels within said treatment zone; and reversable gas circulation means within said top passageway for maintaining the circulation of treatment gas in said other direction through said gas passageway whereby the direction of gas flowing through said treatment zone may be reversed.

According to another aspect the invention provides a method of drying timber in a kiln of the invention. The method comprises stacking timber in spaced layers in the treatment zone, quickly bringing the kiln to its operating temperature, introducing heated treatment gas into the kiln, circulating the gas either in the first or second direction and periodically reversing the flow of the circulating gas until a desired moisture is achieved in the timber.

BRIEF DESCRIPTION OF THE DRAWINGS

A preferred kiln according to the invention will now be described by way of example with reference to the accompanying drawings in which.

DESCRIPTION OF PREFERRED EMBODIMENTS

Figure 1:
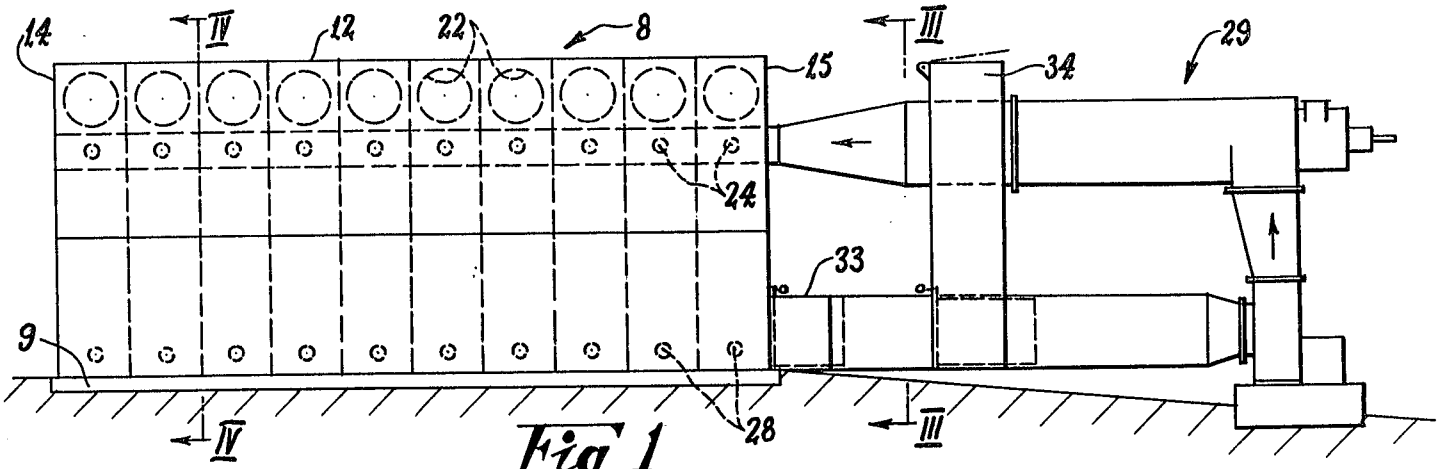
FIG. 1 is an elevational view of an embodiment of a kiln according to the invention.
Figure 2:
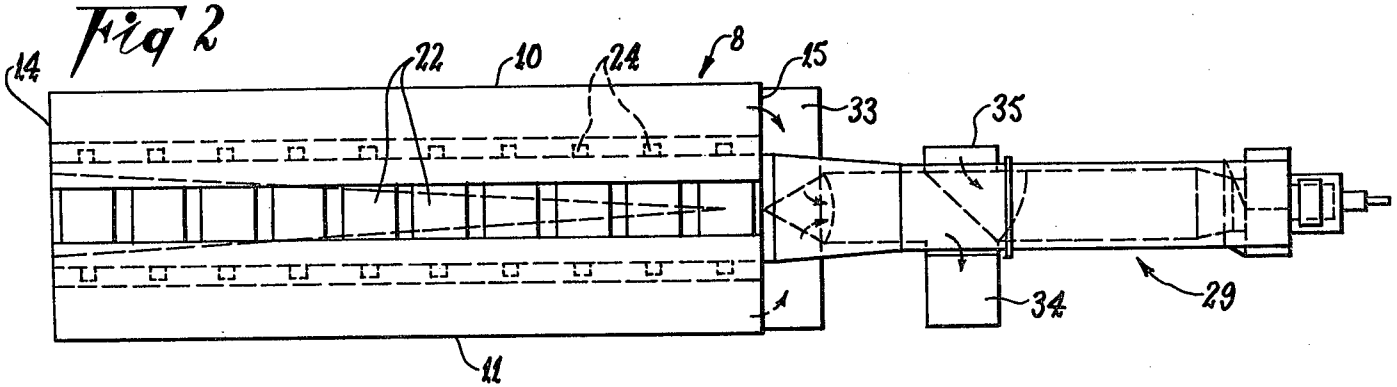
FIG. 2 is a plan view of the kiln illustrated in FIG. 1.

Accordingly, the present invention provides a kiln 8 for the drying of timber. The kiln 8 of the present invention includes an elongated housing to provide a timber treatment zone. The elongated housing is provided by a kiln base 9, a pair of kiln side walls 10, 11 and a kiln top wall 12 defining the timber treatment zone 13 therewithin as far as the lateral cross-section is concerned. A pair of kiln end walls 14, 15 complete the timber treatment zone 13.

In accordance with the invention the kiln side walls 10, 11 and kiln top wall 12 are so shaped as to provide in lateral cross-section a gas circulation passageway about said timber treatment zone. The gas circulation passageway includes a top passageway portion 16 extending over the top of the timber treatment zone, a side passageway portion 18 extending down one side of the timber treatment zone, a treatment passageway portion 19 extending through the timber treatment zone, and a side passageway portion 20 extending up the other side of the timber treatment zone to merge with the top passageway portion 16. Each of the kiln side walls 10,11 is sloped so that each of the side passageway portions is broader at the top and narrower at the bottom thereby uniformly to reduce the flow area of gases circulating within the gas circulation passageway, thus to maintain a substantially uniform velocity of gas at various levels within the timber treatment zone as will be further explained below. It will be seen then that gas within the gas circulation passageway may circulate through the top passageway portion 16 to a side passageway portion 18 through the treatment passageway portion 19 or timber treatment zone and return via the other side passageway portion 20 to the top passageway portion 16, the shape of the gas circulation passageway being such as to provide a substantially even rate of flow at various levels within the timber treatment zone.

Preferably the top passageway portion 16 merges with each of the side passageway portions 18, 20 to provide even flow, preferably by means of a rounded junction 21 between the kiln top wall 12 and each of the kiln side walls 10, 11.

The kiln structure of the present invention provides a gas circulation means preferably within the gas circulation passageway to maintain the circulation of treatment gas in the manner outlined above. Preferably, the gas circulation means is provided by one or more tube axial fans 22.

Preferably the tube axial fan 22 is reversible whereby the direction of circulation within the gas circulation passageway may be reversed.

The kiln structure of the present invention preferably includes one or more inlet ducts for hot air and other gases for timber treatment. Preferably a single longitudinal inlet duct 23 is provided substantially centrally located in the kiln 8. In one suitable form the inlet duct 23 extends longitudinally beneath the top passageway portion 16 and above the timber treatment zone so that replenishment gas may be injected to the gas circulation passageway in the vicinity of the top passageway portion 16. For the purpose one or more inlet ports 24 are provided between the inlet duct and the gas passageway. Since this top passageway portion 16 includes the circulation fan, such as the tube axial fan 22 above referred to the gas within the top passageway portion 16 will be in substantial turbulence thereby enabling early mixture of the replenishment gas and the circulation gas.

Figure 4:
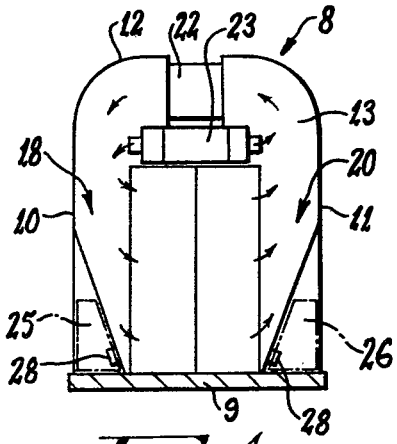
FIG. 4 is a view of the kiln taken along line IV—IV of FIG. 1.
Figure 3:
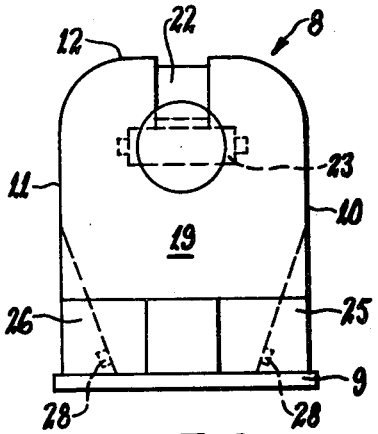
FIG. 3 is a view of the kiln taken along lines III—III of FIG. 1.
Figure 5:
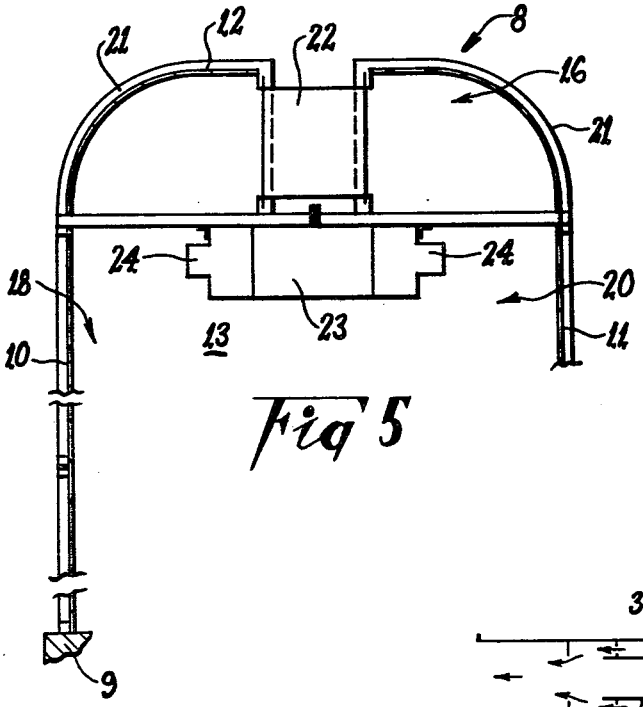
FIG. 5 is a partial enlarged sectional view along line IV—IV showing the top portion of a preferred kiln of the invention; and, FIG. 6 shows one form of burner which may be employed with the kiln of the invention.
Figure 6:
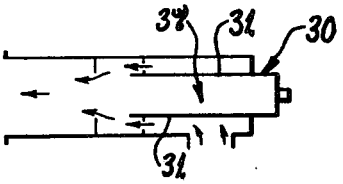

The kiln 8 of the present invention may also include one or more return ducts. Preferably a pair of return ducts 25, 26 are provided one extending along the lower edge of each side passageway portion. In the preferred embodiment, as above discussed, the preferred side passageway portions slope inwardly towards their bottom. Therefore, when the elongated housing is provided in rectangular cross-section there is on the bottom of each side a portion that may provide the return ducts as shown in FIG. 4 of the drawings. Preferably each return duct 25, 26 communicates with the side passageway portion 18, 20 respectively by a series of return nozzles or ports 28 spaced longitudinally therealong.

At one end of the kiln 8 there is preferably provided a heating means 29 to provide heated replenishment gas to the inlet duct 23. The heating means 29 may include a burner 30 such as an oil burner and a pressure burner block or the like, having a chamber 37 for combustion separated by baffles 31 from a cooling air inlet 32. In this way the hot combustion gases may be mixed with air to provide a controlled temperature for the gases entering the inlet duct.

Preferably the return ducts 25, 26 terminate at the same end as the heating means 29 is located. The return ducts 25, 26 terminate in a return duct manifold 33 which is vented by a flue 34 to exhaust a controlled amount of gas and is also connected to the pressure burner block preferably through a circulating gas fan or the like. An air inlet port 35 may be provided in the return duct manifold whereby fresh air may be drawn into the circulating gases.

The preferred operation of the arrangement above described is for the circulating gases to be drawn through the return ducts 25, 26 to the return manifold 33. A portion of the circulating gas is exhausted through the flue 34 and a corresponding quantity of fresh air is drawn through the air inlet port 35 to the manifold 33. In this way there is an exhaust of spent gas thereby to maintain a balance of vapours and other contaminants in the circulating gases whilst avoiding the cost in heating a completely fresh supply of gases (which is necessary if there is a full exhaust of spent gases that have passed through the kiln). The balanced gas in the return duct manifold 33 is then forced by a circulating gas blower to the pressure burner block where hot gas from the heater raises the temperature to the desired level. The heated replenished gas then pass to the inlet duct 23 from which it is distributed to the gas circulation passageway as above described.

Preferably the elongated housing at its other end includes, within the kiln end wall, one or more access doors 36 through which the timber to be dried can be placed. Preferably the size and shape of these doors are adapted to enable stacking of the timber using lift trucks as will appear clear from the drawings annexed hereto.

The kiln 8 itself may be constructed of any suitable material. Preferably the kiln walls are constructed of a suitable metal such as a 16 gauge metal sheet, for example, and provided with insulation. The insulation employed is preferably mineral in nature although other known insulating material of appropriate heat resistance may be used if desired. In one form of construction that has been found suitable, the kiln is provided with external insulation comprising an aluminium clad fibreglass blanket attached to the exterior of the kiln. Preferably, the kiln is constructed of a number of individual modules in lateral cross-section. In this way any suitable number of individual modules may be placed end to end to provide a kiln of desired length for the timber to be treated. For example, in one suitable arrangement, ten modules placed face to face to provide a total kiln has been found satisfactory. Preferably each module includes a separate tube axial fan of the type above indicated and each providing an inlet and a return port for access to the inlet duct and return duct respectfully. Further details of the modular construction will be apparent from a study of the drawings annexed hereto.

According to a preferred method of operation of the kiln, the kiln is first stacked with the timber to be treated. The form of stacking is, as usual, very important. Space must be left between the layers of timber in the stack to allow for circulation of gases about that timber. The kiln is then brought up to operating temperature as quickly as possible. The preferred operating temperature in accordance with the kiln of the present invention is about 180° C. The kiln is able to be brought to this operating temperature in a short time by operation of the burner and venting the minimum of gases through the flue. That is to say, there is an internal circulation of heated gas by operation of the tube axial fans and the circulation gas blower. In the case of pinus radiata boards that are 35 mm in thickness, a warm up time of about 1 hour can be achieved. The kiln is then operated so that the hot side of the timber treatment zone is maintained at about 180° C. during the operations. It will be appreciated that the air flow caused by the tube axial fans results in one side of the timber treatment zone being at a higher temperature than the other. Therefore, it is preferred that the direction of air flow in the kiln be reversed about every four hours. This may be achieved by use of the reversible tangential fans. The periodic reversal of flow of gas in the circulation passageway is maintained until the desired moisture content of the timber in the stack is achieved. This content may be determined by measuring the temperature drop across the stack. The temperature drop is a function of the rate of moisture evaporation governed by the moisture content. A low temperature drop across the treatment passageway indicates that the moisture content of the timber under treatment has been reduced to the desired level. It will be found that whilst maintaining a temperature of 180° C. on the feed side (for the time being) of the treatment passageway, the temperature on the exhaust side will be between about 150° C. and 170° C. At the commencement of operation the temperature differential will be greater than at the end where there is less moisture leaving the timber under treatment. It will be found that the gas within the kiln during operation will increase in moisture content, will become deficient in oxygen and will become contaminated with other volatiles from the timber and with the combustion gases of the fuel used in the burner, for example. To control this there is a venting from the flue with the addition of fresh air to maintain a moisture content, volatile and other contaminant content and oxygen content at a level satisfactory for operation, whilst maintaining an acceptable heat loss level.

It has been found that the operation of the kiln of the present invention provides an even heating of the timber in a short period of time such that a temperature of about 180° C. may be maintained evenly throughout the feed side treatment passageway. It has been found that when operating under these conditions, there is, in comparison with the prior art procedures, less surface checking, less knot cracking, less distortion and less discolouration. It is believed that this occurs because in accordance with the kiln of the present invention, one is able to achieve a fast warm up to the desired temperature, a high velocity of gas between the timber layers, a low relative humidity, an acceptably low oxygen content and an even flow of gas between the timber layers.

What I claim is:

1. A kiln for drying timber comprising:

an elongated housing having a base, two side walls and a top wall and two end walls defining a timber treatment zone;

a gas circulation passageway having a top passageway portion extending over said timber treatment zone, a side passageway portion extending down one side of said timber treatment zone, a treatment passageway portion extending through said timber treatment zone, and a side passageway portion extending up the other side of said timber treatment zone merging with said top passageway portion, each said side wall being sloped whereby each of said side passageway portions is broad at the top of the kiln and narrower at the bottom of the kiln thereby to provide a substantially even rate of flow of gases at various levels within said treatment zone, said top passageway portion forming a rounded junction with each said side passageway portion;

reversible gas circulation means within said top passageway portion for maintaining the circulation of treatment gas in said other direction through said gas passageway thereby enabling the direction of gas flowing through said treatment zone to be reversed; and at least one inlet duct for hot air and other gases for timber treatment, said inlet duct extending longitudinally beneath said top passageway portion and above said treatment zone, said inlet duct having one or more inlet ports between said duct and said gas circulation passageway for injecting gas into said gas circulation passageway in the vicinity of said top passageway portion, said inlet duct having an internal baffle means providing a lumen in said inlet duct which decreases in lateral cross-sectional area from the end of introduction of treatment gas to the end remote therefrom.

2. A kiln according to claim 1 including a return duct extending along the lower edge of each said side passageway portion, each said return duct being defined by a cavity in said side wall and having an inclined wall facing said treatment zone to provide the narrower passageway in the bottom of said side passageway portion, each said return duct providing for the return of gases to a point remote from the introduction of gases into said kiln.

3. A kiln according to claim 2 wherein each said return duct communicates with its associated said side passageway portion by a series of return nozzles spaced longitudinally therealong.

4. A kiln according to claim 3 including heating means for heating and providing gas to said inlet duct.

5. A kiln according to claim 3 wherein said return ducts terminate in a return duct manifold which may be vented to the atmosphere to exhaust a controlled amount of gas and said manifold is in communication with said heating means.

6. A kiln according to claim 5 wherein said return duct manifold includes an air inlet port whereby fresh air may be drawn into the treatment gas.

* * * * *